US006428864B1

(12) United States Patent
Fujita

(10) Patent No.: US 6,428,864 B1
(45) Date of Patent: Aug. 6, 2002

(54) GLASS BOTTLE FOR HIGH-FREQUENCY HEAT SEALING

(75) Inventor: Noriyuki Fujita, Tokyo (JP)

(73) Assignee: Toyo Glass Company, Limited, Tokyo (JP)

( * ) Notice: Subject to any disclaimer, the term of this patent is extended or adjusted under 35 U.S.C. 154(b) by 0 days.

(21) Appl. No.: 09/820,354

(22) Filed: Mar. 29, 2001

(30) Foreign Application Priority Data

Aug. 23, 2000 (JP) ..... 2000-252182

(51) Int. Cl.[7] ..... B65D 41/00

(52) U.S. Cl. ..... 428/34.1; 65/30.1; 65/31; 356/239.4; 215/45; 215/232; 220/359.1; 220/359.4; 216/98

(58) Field of Search ..... 428/34.1; 215/232, 215/45; 220/359.1, 359.4; 65/30.1, 31; 356/239.4; 216/97–98

(56) References Cited

U.S. PATENT DOCUMENTS 4,778,698 A * 10/1988 Ou-Yang ..... 428/35
5,860,461 A 1/1999 Helmut
6,005,338 A * 12/1999 Omae et al. ..... 313/412

FOREIGN PATENT DOCUMENTS

| | | |
|---|---|---|
| JP | 56-23487 | 3/1981 |
| WO | 98 13267 | 4/1998 |

OTHER PUBLICATIONS

Patent Abstracts of Japan, vol. 17, No. 598, Nov. 1993, & JP 05–178332 A (Yasunaga Kuwabara), Jul. 1993 (Abstract).

* cited by examiner

*Primary Examiner*—C. Melissa Koslow
*Assistant Examiner*—Shalie Manlove
(74) *Attorney, Agent, or Firm*—Wenderoth, Lind & Ponack, L.L.P.

(57) ABSTRACT

Glass bottles having undergone high-frequency heat sealing, to depress the dispersion of sealing strength as low as possible and to improve the ease of both sealing and unsealing. A rough surface having minute unevenness is formed in the proximity of the apical part of the mouth of a glass bottle, wherein the apical part contacts with a sealing material. Since (1) a contact area between the sealing material and the glass surface decreases, and the quantity of heat taken by the glass from the sealing material decreases, (2) a bond area increases; and (3) an anchor effect is generated, the sealing strength increases, and simultaneously the dispersion of the sealing strength decreases.

3 Claims, 4 Drawing Sheets

GLASS BOTTLE FOR HIGH-FREQUENCY HEAT SEALING

TECHNICAL FIELD TO WHICH THE INVENTION BELONGS

The present invention relates to a glass bottle sealing of the mouth by high-frequency heat sealing.

PRIOR ART

Glass bottles for high-frequency heat sealing have hitherto been known wherein a sealing material (a film formed of a synthetic resin laminated to aluminum foil at the undersurface) is placed on the mouth of a glass bottle and undergoes high-frequency heating in capping condition, and the film formed of a synthetic resin of a sealing material is welded to an apical part of the mouth to seal. The apical parts of the mouths of conventional glass bottles are smooth.

PROBLEMS THAT THE INVENTION IS TO SOLVE

In the glass bottles sealed by high-frequency heating, the presence of portions low in sealing strength is liable to break the seal. Since the breaking of the seal must be absolutely avoided, the sealing strength must be increased as a whole by making high frequency act strongly. Then areas having extremely high sealing strength are produced, and there arises a problem of making difficult the breaking of the sealing material. The invention has been carried out, in the glass bottles of this kind, aiming at depressing the dispersion of sealing strength as lowly as possible to improve the ease of both sealing and unsealing.

MEANS FOR SOLVING THE PROBLEMS

The invention is a glass bottle for high-frequency heat sealing characterized by forming a rough surface having minute unevenness in the proximity of the apical part of the mouth contacting a sealing material.

Formation of the rough surface having minute unevenness in the proximity of the apical part of the mouth produces the following phenomena:

(1) A contact area between the sealing material and the glass surface decreases, and the quantity of heat taken by the glass from the sealing material decreases.

(2) A bond area increases.

(3) An anchor effect is generated.

Thus the sealing strength increases, and simultaneously the dispersion of the sealing strength decreases. This needs no excessive increase in the sealing strength by making high-frequency act strong to facilitate the breaking of the sealing material.

As processes for forming minute unevenness in the proximity of the apical part of the mouth of a glass bottle, a hydrofluoric acid treatment (frost treatment) can be carried out in the proximity of the apical part of the mouth of a glass bottle molded as usual, or a glass bottle can be molded by use of a mouth mold having a molding surface where the minute unevenness is formed by sandblasting. In view of producing problems such as bad sealability, bad release properties from the mold, a large effect of dirt stemming from releasing agents, and the like, it has been a common sense that the apical surface of the mouth of a glass bottle must form a surface as smooth as possible. However, it has been found that these problems do not arise at all in the case of minute unevenness in examples as described later.

MODE FOR CARRYING OUT THE INVENTION

FIG. 1 is a photograph of the apical surface of the mouth of a glass bottle of an example.

FIG. 2 is a microscopic photograph of the same glass bottle. This glass bottle is subjected to the hydrofluoric acid treatment (frost treatment) in the proximity of the apical part of the glass bottle molded as usual to form minute unevenness of about 5 to about 20 $\mu$m.

FIG. 3 is a photograph of the apical surface of the mouth of a non-treated glass bottle undergoing no hydrofluoric acid treatment.

FIG. 4 is a microscopic photograph of the same glass bottle, and an almost complete smooth surface is formed in the proximity of the apical part of the mouth of the non-treated glass bottle.

The respective four of the frost-treated bottles of the aforesaid examples and non-treated bottles of conventional examples were subjected to the high-frequency heat sealing, and the sealing strength was measured (four areas per bottle). The conditions of the high-frequency sealing are as follows:

| | |
|---|---|
| Distance between Coil and Cap: | 12 mm |
| Torque for Clamping Cap: | 300 to 320 N·cm |
| Sealing Time: | 5 seconds |
| Frequency: | 80 kHz |
| High-Frequency Output: | Voltage 50 V<br>Current 88 A |

Results of the measurement are shown in Table 1. The frost-treated bottles of the examples are small in the dispersion (standard deviation) of the sealing strength and high in bonding strength as compared with the non-treated bottles of the conventional examples.

TABLE 1

Results of Measurement of Bonding Strength of Seal at 80 kHz (N/15 mm)

| | | 1 | 2 | 3 | 4 | Average | Average | Standard Deviation |
|---|---|---|---|---|---|---|---|---|
| Non-Treatment | A | 8.4 | 8.0 | 8.0 | 8.8 | 8.3 | 8.5 | 2.80 |
| | B | 5.2 | 6.5 | 7.0 | 8.8 | 6.9 | | |
| | C | 9.0 | 7.4 | 13.3 | 9.2 | 8.5 | | |
| | D | 5.1 | 5.8 | 9.4 | 15.9 | 9.1 | | |
| Frost Treatment | A | 8.8 | 6.7 | 9.5 | 10.7 | 8.9 | 11.8 | 2.61 |
| | B | 11.4 | 14.5 | 9.9 | 15.6 | 12.9 | | |
| | C | 12.0 | 13.4 | 8.0 | 13.6 | 11.8 | | |
| | D | 13.8 | 14.8 | 12.2 | 13.2 | 13.5 | | |

About the respective eight of the frost-treated bottles of the examples and the non-treated bottles of conventional examples, the aforesaid high-frequency sealing conditions were changed to measure the sealing strength (four areas per bottle). The conditions of the high-frequency sealing are as follows:

| | |
|---|---|
| Distance between Coil and Cap: | 26 mm |
| Torque for Clamping Cap: | 300 to 320 N·cm |
| Sealing Time: | 5 seconds |
| Frequency: | 220 kHz |
| High-Frequency Output: | Voltage 195 V |

Results of the measurement are shown in Table 2. The frost-treated bottles of the examples are small in the dispersion (standard deviation) of the sealing strength and high in bonding strength as compared with the non-treated bottles of the conventional examples.

TABLE 2

Results of Measurement of Bonding Strength of Seal at 220 kHz (N/15 mm)

| | | 1 | 2 | 3 | 4 | Average | Range | Average | Standard Deviation |
|---|---|---|---|---|---|---|---|---|---|
| Non-Treatment | A1 | 9.7 | 10.0 | 8.2 | 7.0 | 8.7 | 3.0 | 6.70 | 2.18 |
| | B1 | 3.4 | 5.8 | 7.3 | 7.3 | 6.0 | 3.9 | | |
| | C1 | 8.9 | 8.7 | 8.8 | 5.2 | 7.9 | 3.7 | | |
| | D1 | 6.5 | 6.9 | 6.4 | 6.5 | 6.6 | 0.5 | | |
| | A2 | 7.0 | 1.6 | 5.7 | 6.1 | 5.1 | 5.4 | | |
| | B2 | 5.2 | 6.9 | 7.2 | 7.2 | 6.6 | 2.0 | | |
| | C2 | 10.1 | 8.0 | 8.7 | 4.8 | 7.9 | 5.3 | | |
| | D2 | 7.4 | 6.0 | 0.0 | 6.0 | 4.9 | 7.4 | | |
| Frost | A1 | 9.3 | 7.9 | 10.6 | 6.8 | 8.7 | 3.8 | 9.06 | 1.61 |
| Treatment | B1 | 9.3 | 11.2 | 9.2 | 12.2 | 10.5 | 3.0 | | |
| | C1 | 10.6 | 8.8 | 10.3 | 9.0 | 9.7 | 1.8 | | |
| | D1 | 8.0 | 9.1 | 6.3 | 10.4 | 8.5 | 4.1 | | |
| | A2 | 10.5 | 6.2 | 10.8 | 8.8 | 9.1 | 4.6 | | |
| | B2 | 6.0 | 10.2 | 9.8 | 9.5 | 8.9 | 4.2 | | |
| | C2 | 9.2 | 9.7 | 10.2 | 8.4 | 9.4 | 1.8 | | |
| | D2 | 9.6 | 9.2 | 5.5 | 7.4 | 7.9 | 4.1 | | |

Furthermore, change in the sealing strength depending upon sealing times was determined at frequencies of 80 kHz and 220 kHz. FIG. 5 shows that at a frequency of 80 kHz, and FIG. 6 that at a frequency of 220 kHz. In either of the cases, the frost-treated bottles of the examples have low slopes in the lines of the graphs in about 7 N/15 mm suitable to the sealing strength as compared with the non-treated bottles of the conventional examples. This means that the frost-treated bottles are small in the change of the sealing strength depending upon the sealing times. That is, some deviation in the sealing time hardly affects the sealing strength (wide operation range), and therefore the high-frequency heat sealing can be carried out in stable sealing strength.

ADVANTAGE OF THE INVENTION

Since the glass bottles of the invention show decrease in the dispersion of the sealing strength together with increase in the sealing strength as compared with the conventional glass bottles, it is unnecessary to increase excessively the sealing strength by making high frequency act strongly to facilitate the breaking of the sealing material. In addition, the wide operation range enables the high-frequency heat sealing in more stable sealing strength.

Figure 1:
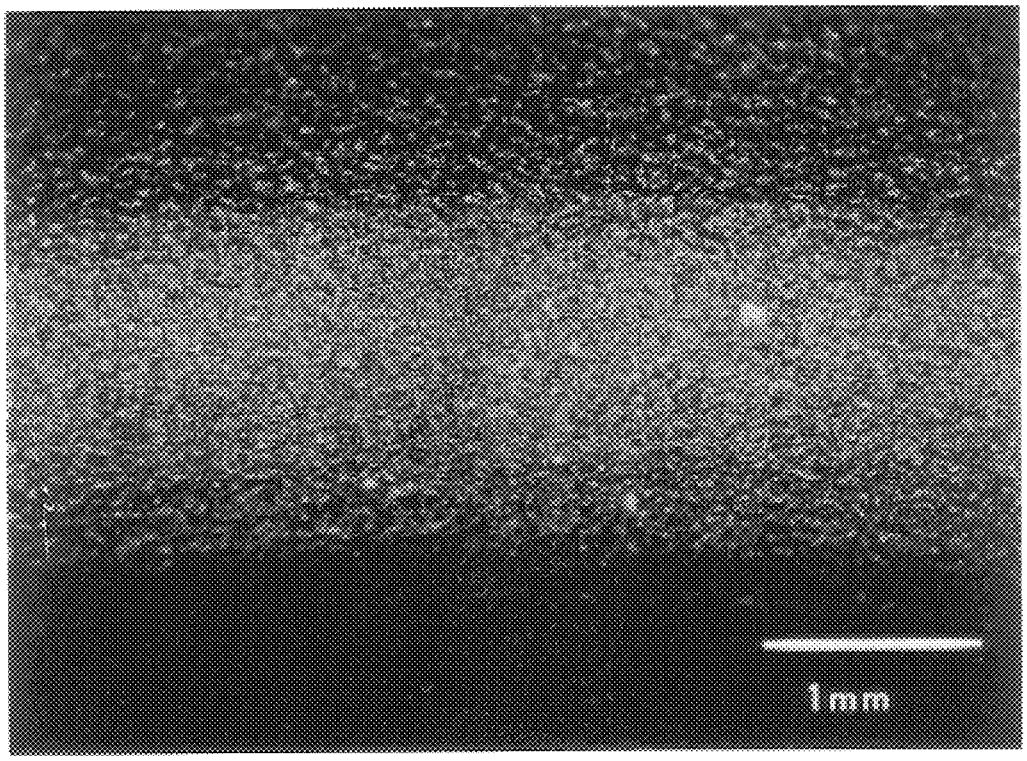
FIG. 1 is a photograph of the apical surface of the mouth of a glass bottle in an example.
Figure 2:
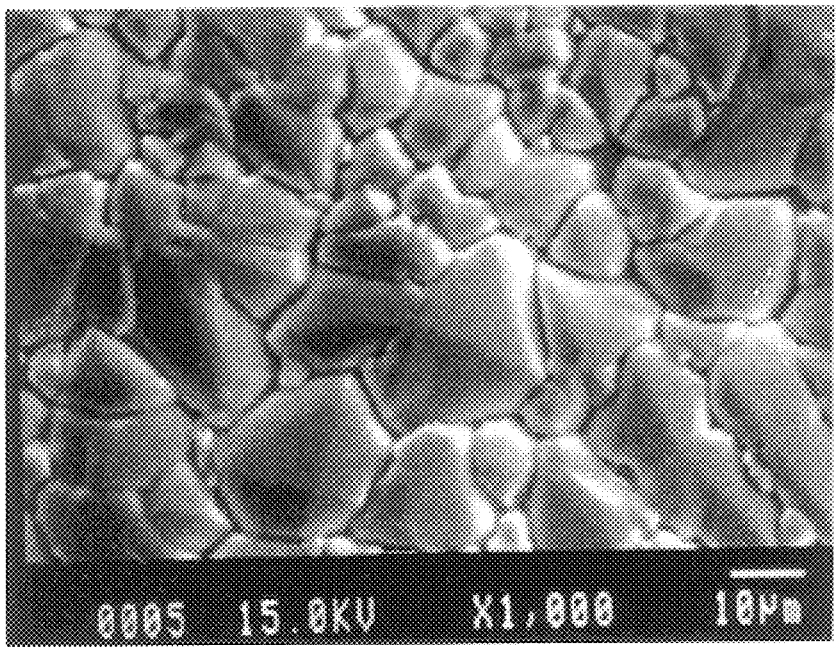
FIG. 2 is a microscopic photograph of the glass bottle in the example.
Figure 3:
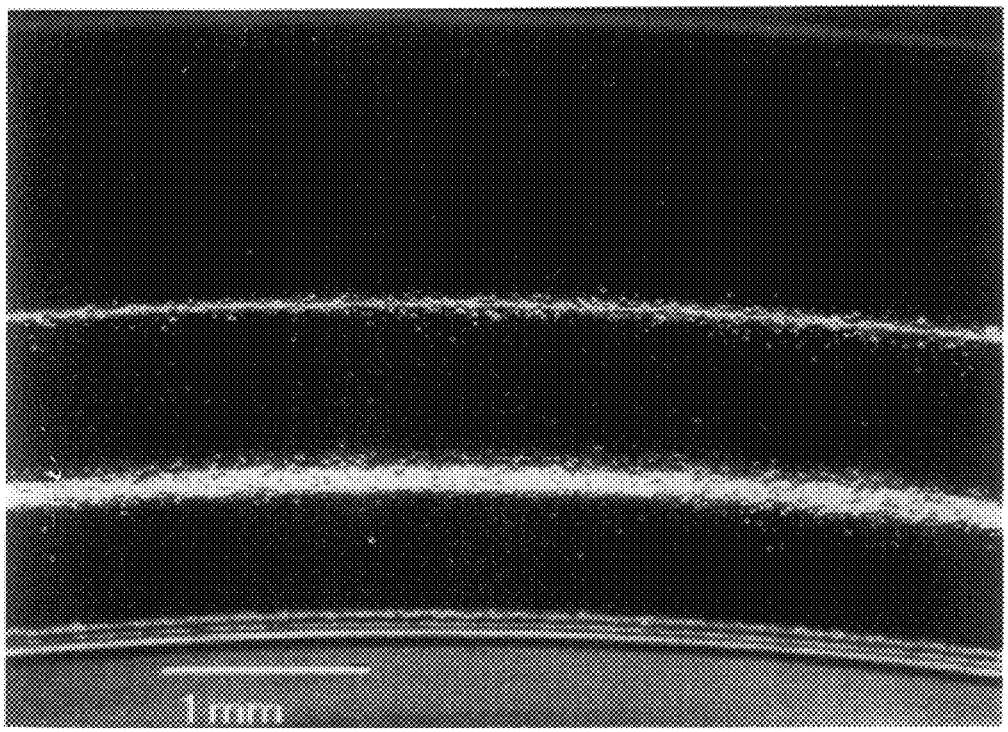
FIG. 3 is a photograph of the apical surface of the mouth of a glass bottle in a conventional example.
Figure 4:
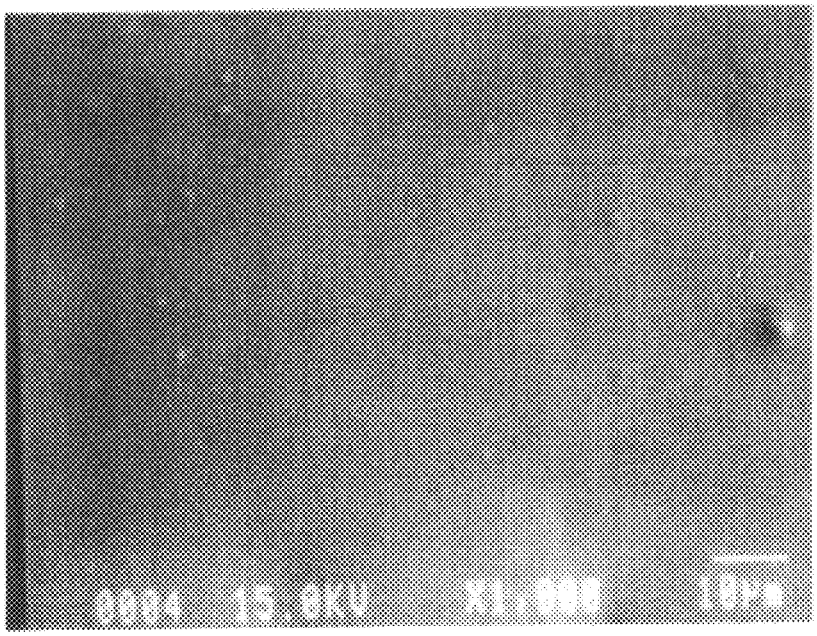
FIG. 4 is a microscopic photograph of the glass bottle in the convention example.
Figure 5:
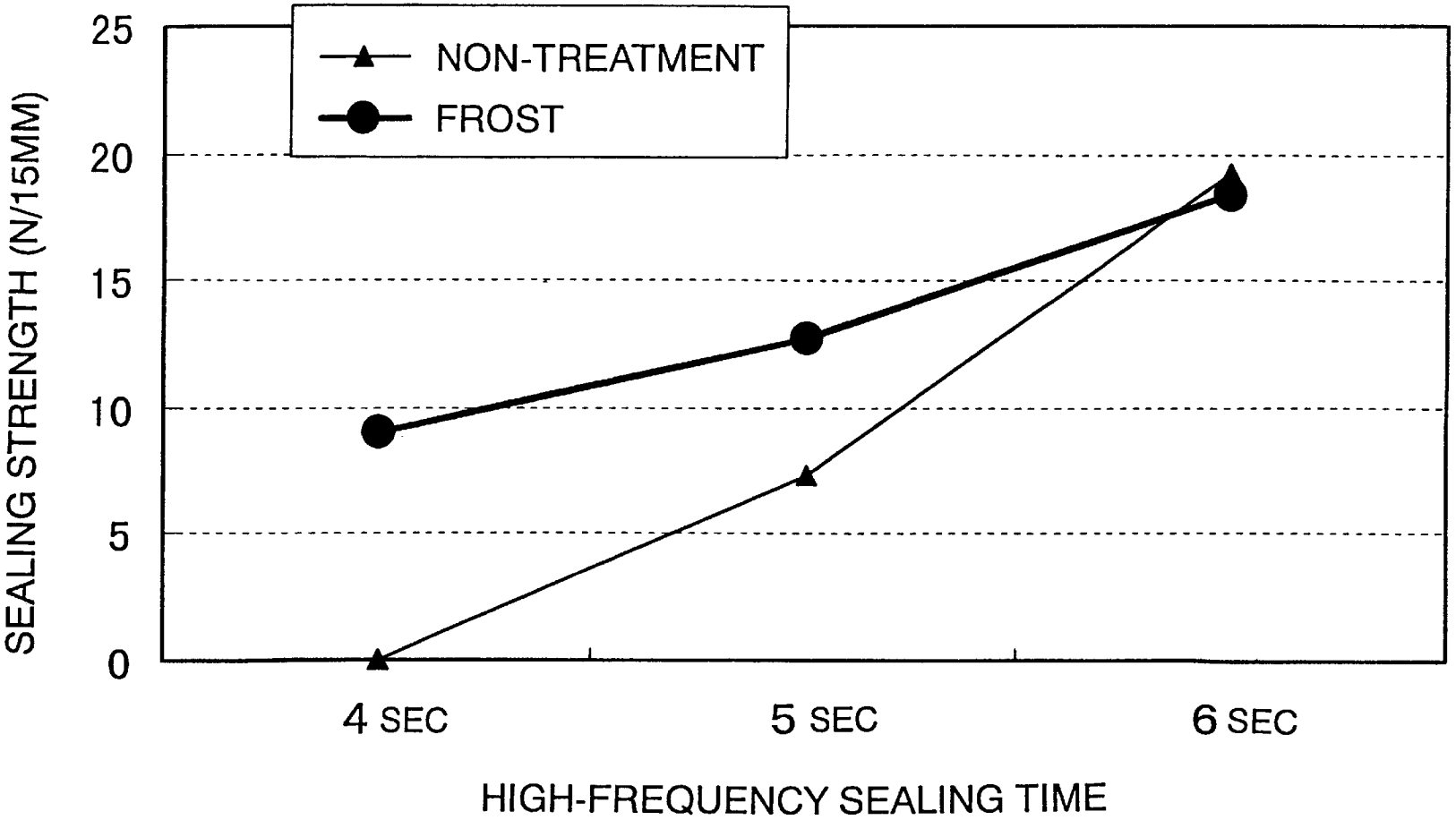
FIG. 5 is a schematic view showing change of the sealing strength depending upon the sealing times at a frequency of 80 kHz.
Figure 6:
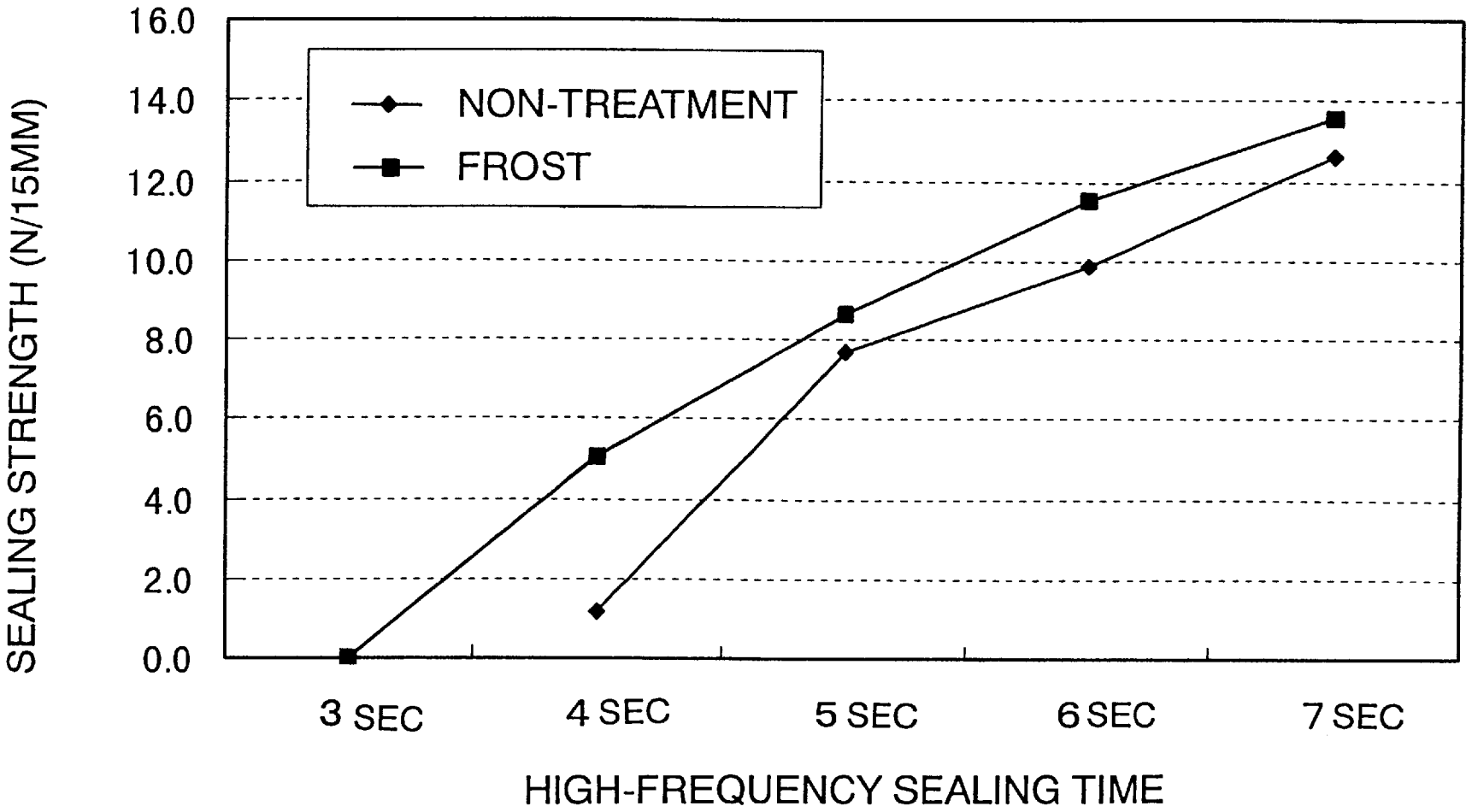
FIG. 6 is a schematic view showing change of the sealing strength depending upon the sealing times at a frequency of 220 kHz.

What is claimed is:

1. A glass bottle for high-frequency heat sealing, having a surface unevenness of about 5 $\mu$m to about 20 $\mu$m at least in an apical part of a mouth for contacting with a sealing material.

2. A process for producing the glass bottle for high-frequency heat sealing of claim 1, which comprises forming the surface having unevenness of about 5 $\mu$m to about 20 $\mu$m by carrying out a hydrofluoric acid treatment at least in the apical part of the mouth of a glass bottle.

3. A process for producing the glass bottle for high-frequency heat sealing of claim 1 which comprises molding a glass bottle with use of a molding surface of a mouth mold having a surface unevenness of about 5 $\mu$m to about 20 $\mu$m on the molding surface.

* * * * *